United States Patent [19]

Yoshida

[11] 4,437,260

[45] Mar. 20, 1984

[54] DOMINO TOPPLING TOY

[75] Inventor: Takashi Yoshida, Tokyo, Japan

[73] Assignee: Yoshida Kogeisha, Tokyo, Japan

[21] Appl. No.: 384,394

[22] Filed: Jun. 2, 1982

[51] Int. Cl.[3] ..... A63H 33/00

[52] U.S. Cl. ..... 46/1 R

[58] Field of Search ..... 46/1 R, 42, 43, 242, 46/241; 273/86 R, 86 C, 86 D

[56] References Cited

U.S. PATENT DOCUMENTS 1,802,433 4/1931 Lehmann ..... 46/42

2,522,133 9/1950 Sanders ..... 46/43

*Primary Examiner*—Mickey Yu

*Attorney, Agent, or Firm*—Armstrong, Nikaido, Marmelstein and Kubovcik

[57] ABSTRACT

A domino toppling toy is provided which is capable of toppling a plurality of domino pieces in domino trains located at different vertical elevations. The last domino piece in a lower domino train actuates an actuation lever and hence a locking lever. The locking lever then releases a lock of an upwardly energized lifter carriage movement. An intermediate domino piece disposed in the lifter carriage in an upright position topples down outwardly from the lifter carriage on to the first domino piece in an upper domino train, when the lifter carriage is stopped by a stopper plate for further upward movement, thus enabling to drive the higher domino train by the toppling force of the lower domino train.

5 Claims, 2 Drawing Figures

DOMINO TOPPLING TOY

BACKGROUND OF THE INVENTION

The present invention relates generally to a domino toppling toy for sequentially toppling a plurality of domino pieces standing in alignment in a domino train. More specifically, the invention relates to a domino toppling toy capable of toppling a plurality of domino pieces in domino trains located at different vertical elevations.

A domino toppling game is one of the most popular amusements. There have been developed various appliances for making domino toppling more interesting or attractive. A novel appliance for use in a domino toppling game has long been desired which can topple sequentially a plurality of domino pieces in domino trains located at different vertical elevations. In order to effect the above function, there has been devised a novel means for transmitting a toppling force from a preceding domino train to a succeeding domino train at a different vertical elevation.

Transmission of the toppling force can be achieved by lifting up one intermediate domino piece in standing position and the toppling down the lifted intermediate domino piece at an elevation corresponding to the succeeding domino train. The invention is to provide a device for lifting up one intermediate domino piece to the elevation corresponding to the succeeding domino train.

SUMMARY OF THE INVENTION

Therefore, it is an object of the present invention to provide a domino toppling toy capable of transmitting a toppling force in a lower domino train to an upper domino train.

A further and more specific object of the present invention is to provide a domino toppling toy having a novel means for lifting up an intermediate domino piece in response to the toppling of the last domino piece in a lower domino train, and toppling the lifted intermediate domino piece in order to topple the first domino piece in another upper domino train.

To accomplish the above-mentioned and other objects, there is provided a domino toppling toy for toppling a plurality of domino pieces in domino trains located at different vertical elevations, which comprises a carriage for transporting at least one intermediate domino piece and adapted to move up and down; first means for applying an upward force to move the carriage upwardly; second means for holding the carriage at a lower position against the upward force applied to the carriage by the first means; third means for disabling the second means to hold the carriage at the lower position; and fourth means for stopping the upward movement of the carriage after the third means disabled the operation of the second means. In the domino toppling toy thus constructed, the third means is actuated by the last domino piece in a lower domino train, and the first domino piece in an upper elevational domino train is toppled down in response to a toppling of the at least one intermediate domino piece which is caused by a shock exerted when the fourth means stops the upward movement.

The present invention will be understood more fully from the detailed description given hereinbelow and from the accompanying drawings of the preferred embodiment of the present invention, which, however, should not be taken as limitative to the present invention but for elucidation and explanation only.

DESCRIPTION OF THE PREFERRED EMBODIMENT

Figures 1, 2:
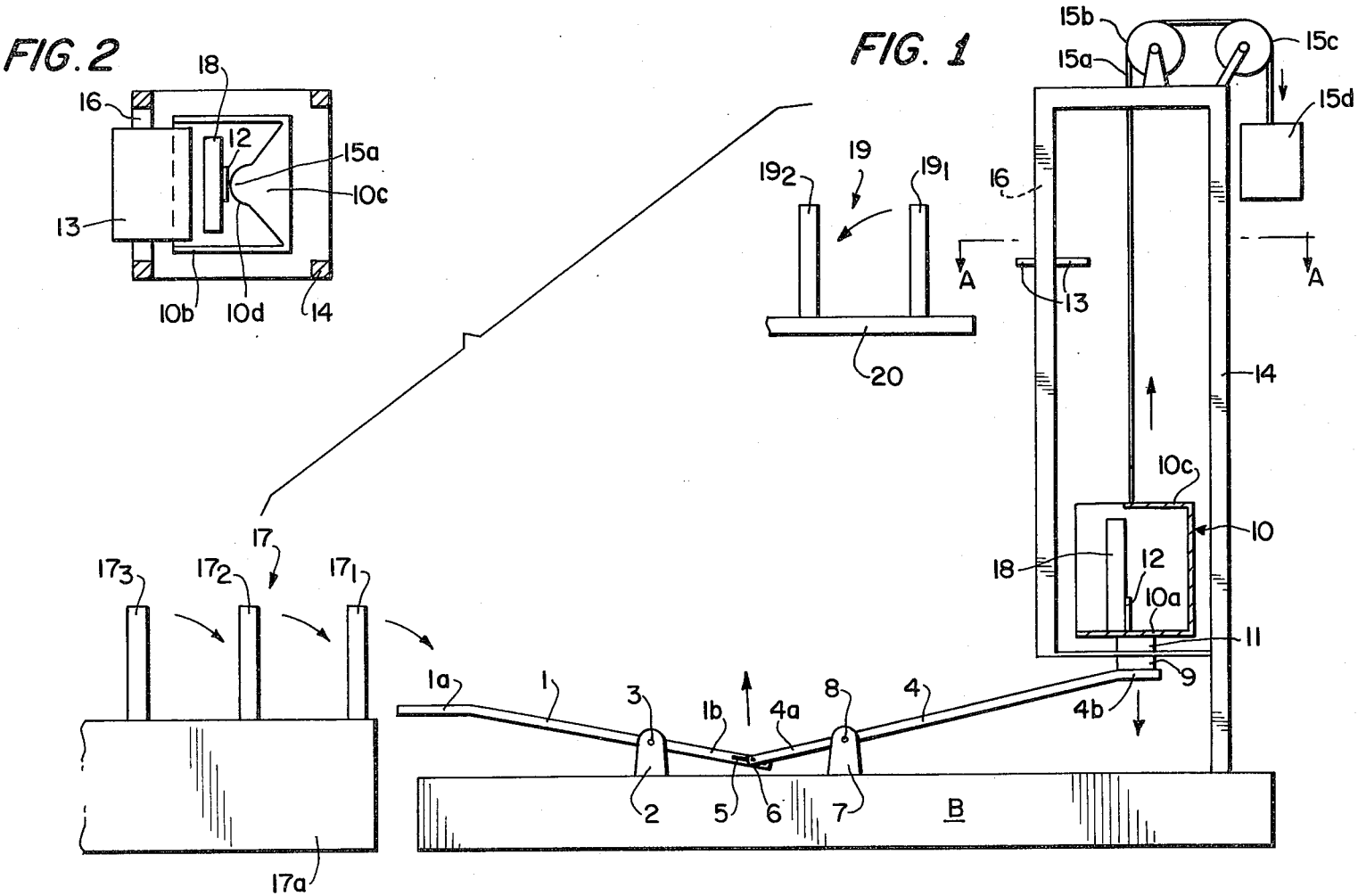
FIG. 1 is a side elevation of a preferred embodiment of the domino toppling toy according to the present invention.
FIG. 2 is a cross-section of the domino toppling toy of FIG. 1 seen from line A—A of FIG. 1.

Referring now to the drawings, particularly to FIG. 1, there is illustrated the preferred embodiment of a domino toppling toy according to the present invention. As shown in FIG. 1, each domino piece $17_1$, $17_2$, $17_3$ . . . constitute a lower domino train 17 which is disposed one after another on a base 17*a*. Likewise, each domino piece $19_1$, $19_2$ . . . constitute an upper domino train 19 which is disposed one after another on a base 20. The base 20 is located at an upper elevation with respect to the base 17*a*. A lifter device is interposed between the upper and lower domino trains 19 and 17, whereby a toppling force of the last domino piece $17_1$ in the lower domino train 17*a* is transmitted to the first domino piece $19_1$ in the upper domino train, as hereinunder described in detail.

The lifter device has an actuation lever 1 which is pivotable about a pivot 3 supported on a base B with brackets 2. The actuation lever 1 has one end 1*a* location adjacent the last domino piece $17_1$ positioned at the end of the lower domino train 17, so that when the last domino piece $17_1$ topples down to the one end 1*a*, it can pushes the end 1*a* downwardly. An elongated opening 5 is formed at the other end 1*b* of the actuation lever 1. A locking lever 4 is also pivotably supported on the base B around a pivot 8 formed on brackets 7 extending upwardly from the base B. The locking lever 4 has one end 4*a* provided with a connector pin 6. The connector pin 6 is engaged with the above elongated opening 5 of the actuation lever 1 in such a manner that the connector pin 6 can slide along the inner periphery of the elongated opening 5. The locking lever 4 has a magnet 9 secured on the other end 4*b* thereof.

A lifter frame 14 is supported on the base B and is so constructed as to permit a vertical movement of a lifting carriage 10 therewithin. As shown in FIGS. 1 and 2, the lifting carriage 10 comprises a bottom palte 10*a* to which a magnet 11 having a pole opposite to that of the magnet 9 of the locking lever 4 is attached, a pair of slide walls 10*b* extending from the bottom plate 10*a*, and a top plate 10*c*. As apparent from FIG. 2, the top plate 10*c* has a length shorter than that of the bottom plate 10*a* and has a semi-circular free end 10*d*. At the semi-circular free end 10*d*, fixedly secured is a connecting code 15*a* which passes through the space in the lifter frame 14 and extends outwardly via pullys 15*b* and 15*c* mounted on the top of the frame 14 with brackets 15*e* and 15*f* to a counter weight 15*d*.

The lifter frame 14 is provided with a horizontally extending stopper plate 13 at the opening 15 which serves as an outlet for an intermediate domino piece 18 disposed in a standing position in the lifting carriage 10. The intermediate domino piece 18 in the lifting carriage 10 is supported by a support extension 12 vertically extended from the bottom plate 10*a* of the lifting carriage 10 so as not to topple down during its transportation to the lifted position. The stopper plate 13 extends into the internal space of the frame 14 so that the stopper plate 13 may limit an upward movement of the lifting carriage 10 by abutting against the bottom plate 10*a* of the lifting carriage 10. As seen from FIG. 1, the stopper plate 13 is located at an elevation higher than that of the base 20 on which the upper domino train 19 is disposed in alignment.

In a position shown in FIG. 1, the magnets 11 and 9 fixedly secured on the respective carriage 10 and locking lever 4 operate to attract each other to hold the lifting carriage 10 at the lowered position. At this position, the lifting carriage 10 is prevented from an upward movement by a magnetic force between the magnets 11 and 9 against an upward force applied by the counter weight 15*d*. By a magnetic attraction of the magnets 11 and 9, the locking lever 4 is held in a counterclockwise position in FIG. 1 thereby to lift up the end 4*b* about the pivot 8. Due to the counterclockwise position of the locking lever 4, the actuation lever 1 interconnected with the locking lever 4 by means of the connector pin 6 is held in a clockwise position about the pivot 3 in FIG. 1 thereby to locate the end 1*a* adjacent the last domino piece $17_1$ in the domino train 17, at a raised position.

When the last domino piece $17_1$ is toppled, since the domino $17_1$ is placed at the end of the base 17*a*, it falls down just onto the end 1*a* of the locking lever 1 to apply a downward force thereto. As a result, the actuation lever 1 rotates about the pivot 3 in a counterclockwise direction to lift up the end 1*b* connected to the end 4*a* of the locking lever 4. This causes a clockwise rotation of the locking lever 4 against the magnetic attraction force described above. Thus, the magnet 9 is released from engagement with the magnet 11 and hence the lifter carriage 10 from the magnetic force. The lifter carriage 10 free from the magnetic force travels upwardly with an upward force applied by the counter weight 15*d*. During the upward travel, the bottom plate 10*a* abuts with the stopper plate 13 to prevent the lifter carriage 10 from moving further upwardly. Upon abutting the bottom plate 10*a* of the lifter carriage 10 with the stopper plate 13, a shock is applied to the carriage 10 to cause a toppling of the intermediate domino piece 18. The intermediate domino piece 18 is then falls down through the opening 16 to cause a toppling of the first domino piece $19_1$ of the upper domino train 19.

As appreciated from the foregoing, the toppling force of the last domino piece placed in the lower elevation can be transmitted to the fixed domino piece in the upper elevation easily and successfully. This will make playing a domino game more interesting.

The present invention has been disclosed in terms of the specific embodiment of the present invention, the invention, however, should not be limited to the specific embodiment but be understood as to include all of the possible modifications except departing from the principle thereof. For example, the magnets used for holding the lifter carriage are not always necessary to be provided on both carriage and locking lever. The holding means for the lifter carriage at the lowered position can be embodied by a single magnet or any other appropriate constructions. Furthermore, the means for applying an upward force to the lifter carriage may be replaced by a spring pulling carriage upwardly. Therefore, the invention should be understood as including any of possible embodiments covered in a scope of the following appended claims.

What is claimed is:

1. A domino toppling toy for toppling a plurality of domino pieces in domino trains located at different vertical elevations, comprising:

a carriage for transporting at least one intermediate domino piece and adapted to move up and down;

first means for applying an upward force to move said carriage upwardly;

second means for holding said carriage at a lower position against the upward force applied to the carriage by said first means;

third means for disabling said second means to hold said carriage at said lower position; and fourth means for stopping the upward movement of said carriage after said third means disabled the operation of said second means, whereby said third means is actuated by the last domino piece in a lower domino train, and the first domino piece in an upper elevational domino train is toppled down in response to a toppling of said at least one intermediate domino piece which is caused by a shock exerted when said fourth means stops said upward movement.

2. A toy as set forth in claim 1, wherein said second means comprises a magnet magnetically acting against the upward force to hold said carriage at said lower position.

3. A toy as set forth in claim 1 or 2, wherein said first means comprises a counter weight connected to said carriage for applying thereto said upward force.

4. A toy as set forth in claim 2, wherein said third means comprises a pair of seesaw-like members for making said carriage free from magnetic holding force, to permit the upward movement of said carriage when said seesaw-like members are applied with the toppling force of said last domino piece.

5. A toy as set forth in claim 3, wherein said third means comprises a pair of seesaw-like members for making said carriage free from magnetic holding force, to permit the upward movement of said carriage when said seesaw-like members are applied with the toppling force of said last domino piece.

* * * * *